US005320122A

United States Patent [19]

Jacobson, II et al.

[11] Patent Number: 5,320,122

[45] Date of Patent: Jun. 14, 1994

[54] COMBINED WALKER AND WHEELCHAIR

[75] Inventors: Julius H. Jacobson, II, 1125 Fifth Ave., New York, N.Y. 10028; Jeffrey Kapec, Westport, Conn.; Kazuna Tanaka, Cos Cob, Conn.; Samuel Montague, Norwalk, Conn.

[73] Assignee: Julius H. Jacobson, II, New York, N.Y.

[21] Appl. No.: 725,184

[22] Filed: Jul. 3, 1991

[51] Int. Cl.[5] ..... A45B 3/00

[52] U.S. Cl. ..... 135/66; 135/67; 297/6; 297/344.12; 297/DIG. 10; 280/304.1

[58] Field of Search ..... 135/65-67; 482/66, 68; 297/DIG. 10, 5, 6, 345, 338, 344, 346; 280/304.1

[56] References Cited

U.S. PATENT DOCUMENTS

| | | | |
|---|---|---|---|
| 1,307,058 | 6/1919 | McGrath . | |
| 1,917,440 | 7/1933 | Finkbeiner et al. . | |
| 2,129,260 | 9/1938 | Bowser | 155/22 |
| 2,362,466 | 11/1944 | Carter | 155/22 |
| 2,374,182 | 4/1945 | Duke | 155/22 |
| 2,539,034 | 1/1951 | Ruby | 297/DIG. 10 X |
| 2,745,465 | 5/1956 | Hogan | 155/23 |
| 2,759,525 | 8/1956 | Ries | 135/67 X |
| 2,866,495 | 12/1958 | Diehl et al. | 297/6 |
| 3,350,095 | 10/1967 | Clasen | 482/68 |
| 3,872,945 | 3/1975 | Hickman et al. | 297/5 X |
| 3,993,349 | 11/1976 | Neufeld et al. | 297/6 |
| 4,007,960 | 2/1977 | Gaffney | 297/DIG. 10 X |
| 4,046,374 | 9/1977 | Breyley | 272/70.3 |
| 4,187,869 | 2/1980 | Marchetti | 135/67 |
| 4,277,100 | 7/1981 | Beougher | 135/67 X |
| 4,621,804 | 11/1986 | Mueller | 272/70.3 |
| 4,623,163 | 11/1986 | Potts | 280/649 |
| 4,800,910 | 1/1989 | Gamm | 297/6 X |
| 4,809,804 | 3/1989 | Houston et al. | 297/DIG. 10 X |
| 4,861,051 | 8/1989 | Napper | 280/87.021 |
| 4,946,222 | 8/1990 | Matson | 297/345 |

*Primary Examiner*—Carl D. Friedman
*Assistant Examiner*—Lan C. Mai
*Attorney, Agent, or Firm*—Darby & Darby

[57] ABSTRACT

A device for supporting a person while standing or walking or sitting having a frame and a seat assembly. The frame supports the person while walking or standing while the seat assembly allows him to sit. The seat assembly is slidably attached to the frame between a raised position and a lowered position. The seat assembly is spring biased towards the raised position. The seat assembly moves from the raised position to the lowered position when the person sits down. The action of the spring biasing assists the person up as the person stands from the seat assembly. The seat assembly includes a main seat portion and a pivotal seat portion. The pivotal seat portion is collapsible from a supportive position where both seat portions provide support to the person and a stowed position where at least the collapsible portion of the seat is tucked away from the person while the person is walking. The pivotal seat portion moves automatically between the two positions in response to the weight of the person exerted on the main seat portion.

17 Claims, 4 Drawing Sheets

FIG. 6
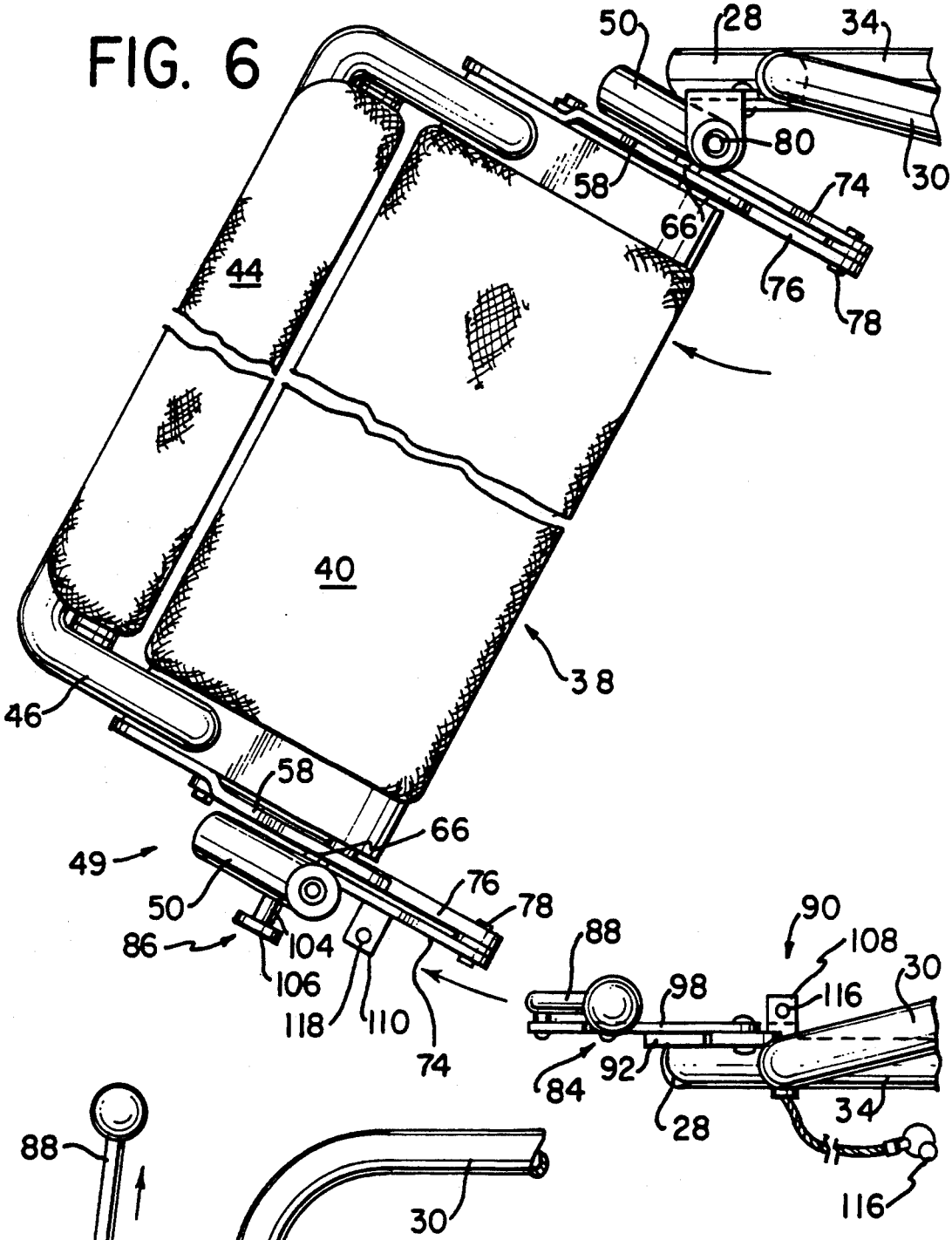
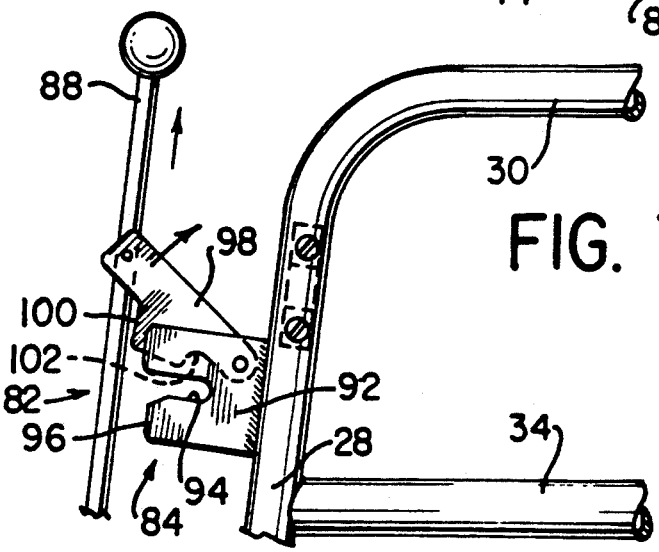
FIG. 7

COMBINED WALKER AND WHEELCHAIR

FIELD OF THE INVENTION

The invention relates to an orthopedic device commonly known as a walker which is used by the aged or disabled as a support while walking. The invention particularly relates to an improved walker having an integral seat assembly which allows the user to sit and rest without difficulty and which further assists the user in standing upright.

BACKGROUND OF THE INVENTION

Walkers having integral seats are shown in several U.S. patents including U.S. Pat. Nos. 4,861,051, 4,623,163, 4,187,869, 4,046,374, 2,745,465, 2,374,182, 2,362,466, 2,129,260, 1,917,440 and 1,307,058. Among the above-listed patents, most of the disclosed seat assemblies are connected to the frame of the walker. Only two allow for vertical seat adjustment; U.S. Pat. Nos. 2,362,466 and 4,187,869, and neither of these two patents discloses seat arrangements which effectively assist the user in standing upright from the seated position.

In U.S. Pat. No. 4,187,869, a walker is disclosed having a vertically adjustable seat which is adjusted by rotating a vertically positioned lead screw to which the seat is indirectly engaged. Although this action causes the seat height to change, the seat is not intended to be raised or lowered while the user is sitting; therefore, this action does not help the user to stand up from the seat. Even if the this seat arrangement were intended to help the user stand upright, the turning of the lead screw is not automatic and would require much strength either from the seated user (which may be lacking) or an assistant.

The seat arrangement of the walker disclosed in U.S. Pat. No. 2,362,466 is hydraulically actuated by a hand pump mounted to the frame of the walker. This height adjustment of this seat is again not intended to help the user to an upright position. Like U.S. Pat. No. 4,187,869, the lifting action of the seat is neither automatic nor easily operated.

The various seat arrangements disclosed in the above-listed patents are not intended to be automatically moved away from the legs of the user while he or she is using the walker. The seat assemblies of these patents restrict the stride of the user and could cause the user to fall by interfering with his or her walking.

The following patents of those listed above disclose walking aid devices which have seat assemblies that are intended to be swung into an operational position (ready to support a seated person) and moved, if necessary and when not in use, from the legs of the user. U.S. Pat. No. 2,374,182 discloses an invalid walker having a frame which surrounds a user and supports him as he walks. The frame has an opening which allows the user access to within the frame. A seat may be swung from a stowed position located on the frame to a position lying across the opening. The seat when locked in its operative position allows the user to sit down and rest.

One problem with the seat disclosed in the '182 patent is that it must be moved to the operative position when the user wishes to sit. Depending on the condition of the user, he cannot be expected to operate the seat himself and an attempt to do so could cause the user to fall. Furthermore, the operative seat assembly is made so that it will not interfere with the legs of the user as he walks; however, the seat assembly has a relatively small supporting surface which may fail to retain an invalid in the seated position.

In the "walking" crutch disclosed by U.S. Pat. No. 1,917,440, a seat assembly is provided which may fold from a stowed position where it is away from the moving legs of the user to an operative position where the user my sit. Like the seat of U.S. Pat. No. 2,374,182, the seat of U.S. Pat. No. 1,917,440 must be moved to the operative position before the user sits. Also, the seat of U.S. Pat. No. 1,917,440 is made with a small supporting surface so that it may be swung down to its operative position without moving the user (or having the user move) away from the support of the frame of the crutch. This small supporting surface provides little support to the user's thighs, where it is needed to retain the user in the seat. It is likely that an invalid using the seat assembly of U.S. Pat. No. 1,917,440 would fall from it due to the lack of support under his thighs.

A similar seating assembly is shown in U.S. Pat. No. 2,362,466. Here, the seat again must be moved to an operative position from a stowed position and again, due to its size, will provide little support where it is needed by the user.

Certain walkers in the prior art have seats similar to bicycle seats, as shown by U.S. Pat. Nos. 4,187,869, 1,307,058 and 1,917,440. Although these seats, for the most part, may be permanently located in a supportive position with respect to the user without interfering with the walking action of the user, they provide very little support to keep an invalid seated and should he fall, the seat itself could cause injury.

Accordingly, it is an object of the invention to provide a walker having an integral seat assembly which automatically provides lifting assistance to a user to help the user stand upright from a seated position.

Another object of the invention is to provide an integral seat assembly for a walker which is automatically moveable between a stowed position, wherein the seat is away from the user's legs as he walks, and an operative position wherein the seat supports the user as he sits.

Another object of the invention is to provide such an automatically moveable seat assembly for a walker wherein the seat moves between its positions in response to the weight of the user as he sits.

Another object of the invention is to provide a seat assembly of which at least a portion automatically folds out of the way when it is not needed and automatically unfolds, when needed, to form a seat having a large supporting surface, yet not interfering with the walking action of the user.

SUMMARY OF THE INVENTION

A device for supporting a person while standing or walking or sitting comprising a frame and a seat assembly. The seat assembly is slidably attached to the frame and movable between a raised position and a lowered position. The seat assembly is spring biased toward the raised position and moves from the raised position to the lowered position when the person sits down. The action of the spring biasing helps the person to rise as the person tries to stand. The seat assembly includes a main seat portion and a pivotal seat portion. The pivotal seat portion is collapsible from a supportive position where both seat portions provide support to the person and a stowed position where at least the collapsible portion of the seat is tucked away from the person while the person is walking. The pivotal seat portion moves automatically between the two positions in response to the weight of the person exerted on the main seat portion.

BRIEF DESCRIPTION OF THE DRAWINGS

FIG. 6 is a top view of the seat assembly in accordance with the invention showing the seat assembly in an open position; and FIG. 7 is a side view of a latch mechanism in accordance with the invention.

DETAILED DESCRIPTION OF THE PREFERRED EMBODIMENT

Figure 1:
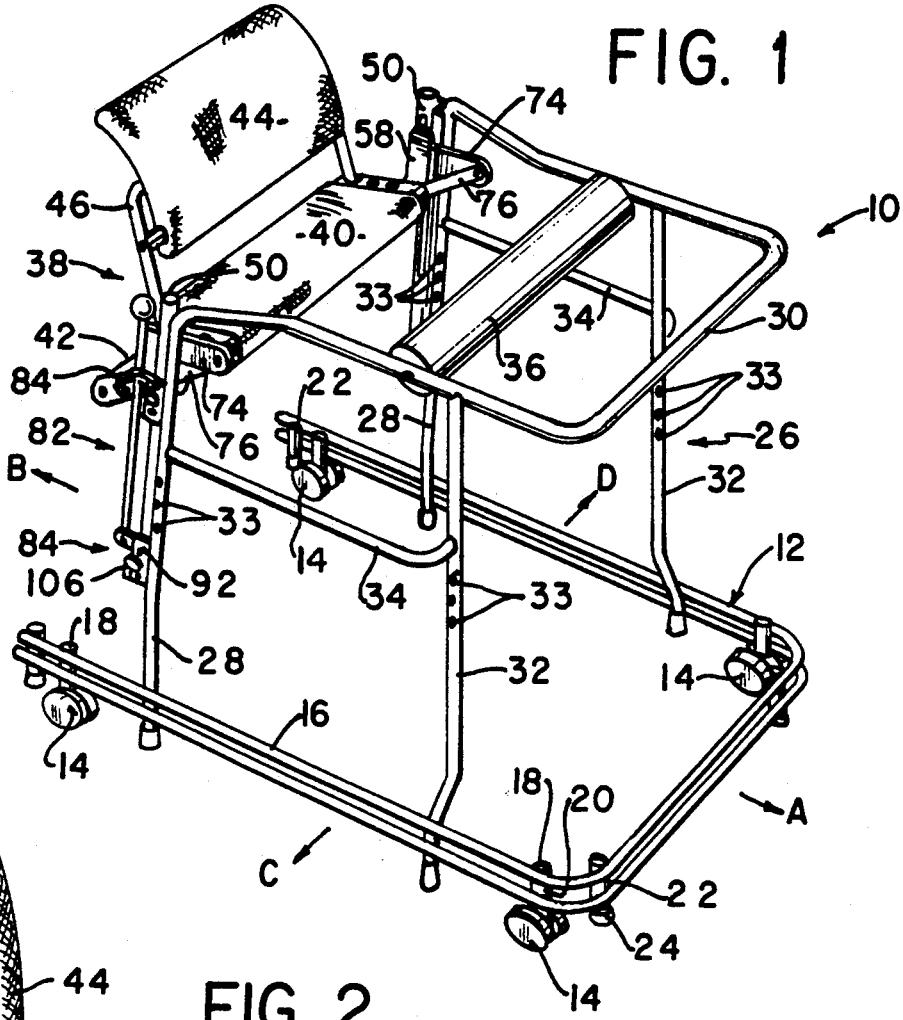
FIG. 1 is an overall isometric view of an invalid walking aid device embodying a seat assembly of the present invention.

Referring to FIG. 1, there is illustrated a walker 10 having a U-shaped dolly 12. The walker 10 has a front end A, a back end B, and two sides, C and D, respectively. The U-shaped dolly 12 is open at its back end B, as shown in FIG. 1 and closed at its front end A and its sides C and D.

The dolly 12 preferably includes four wheels 14 which are each pivotally attached to the dolly frame 16 by a pivot pin 18 (attached to the wheel) and a tubular sleeve 20 (attached to the dolly frame 16). Each wheel 14 is preferably movable vertically within its sleeve so that the dolly frame 16 may be moved up and down between a highest position and a lowest position with respect to the floor along the pivot pins 18 of each wheel 14. A spring (not shown) is preferably included to keep the dolly frame 16 at its highest position. Only when the dolly frame 16 is pushed down against the action of the spring (not shown) will the dolly frame 16 reach its lowest position.

Also attached to the dolly frame 16 are four downwardly directed legs 22 each having at their lower ends (closest to the floor) a non-skid foot 24 made from rubber, for example. The length of the legs 22 is such that when the dolly frame 16 is in its lowest position the non-skid foot 24 of each leg 22 contacts the floor and prevents the dolly 12 from moving along the floor. However, when the dolly frame 16 is in its highest (rest) position, the non-skid feet of the legs 22 are raised above the floor, allowing the dolly 12 to be moved freely along the floor.

A frame structure 26 is attached to the dolly 12. The frame structure 26 comprises a pair of rear support tubes 28 which are connected directly to the dolly frame 16, one on each side C and D. The rear support tubes 28 extend vertically above the dolly 12 to a U-shaped handle frame 30. The handle frame 30 lies in a plane which is generally parallel to the dolly frame 16 and follows the basic shape ("U") of the dolly frame 16. The handle frame 30 is also open at its back end B. The handle frame 30 may preferably be formed integrally with the two rear support tubes 28, as shown in FIG. 1. A pair of forward support tubes 32 are attached to the front end of the dolly frame 16 and the front end of the handle frame 30. The forward support tubes 32 help support the handle frame 30 under any weight applied thereto by the user and also provide general structural integrity. To further strengthen the frame structure 26 and also provide side handles for the user, side bars 34 are connected between the rear and forward support tubes 28 and 32, respectively, as shown in FIG. 1. The length of the support tubes 28 and 32 are preferably adjustable, thereby accommodating patients having different heights. Any suitable adjustment technique may be used, such as a telescoping arrangement (not shown) having several openings 33, one of which in each tube 28, 32 receives a spring loaded peg (not shown). The peg locks the telescoped support tubes 28, 32 at the appropriate and desired length. The height of the assembly is thereby adjustably controlled.

Also, a waist support bar 36 is preferably connected between the sides C and D of the handle frame 30. The waist support bar 36 is padded and functions as a comfortable support for the waist of the user to lean against and assist him or her in moving the device 10 along the floor. The waist support bar 36 also functions as a support handle for the user to use while sitting or standing, as described in greater detail below. In a preferred embodiment, the waist bar 36 is adjustable along the handle frame 30 to accommodate different sized patients. For example, to safely prevent a very thin patient from sliding out from between the seat assembly 38 and the waist support bar 36, the waist support bar 36 is positioned close to the seat. If the very thin patient does collapse while standing the waist support bar 36 will guide him safely into the seat.

The device thus described has an open back end B through which the user may enter the frame structure and use the device. As described below, this open back end can be "closed" by a swingable seat assembly 38 (similar to a gate) which may be swung between an open position (see FIG. 6) providing passage of the user to enter and exit the frame structure 26 and a closed position (shown in FIGS. 1, 2, 3, 4 and 5) and which, if the user is already within the device 10, retains him in the device and prevents him from falling backwards.

Referring to FIGS. 1, 2, 3, 4 and 5, the basic elements of the seat assembly 38 include a bottom seat 40, a swingable thigh support 42, and a back support 44. The back support 44 is attached to the bottom seat 40 with a supporting bar 46. The back support 44 is preferably pivotally connected to the support bar 46 so that the back support 44 may tilt to the comfort of the user when seated. The support bar 46 is preferably one piece, extending behind the back support and connecting both sides of the back support 44 to the bottom seat 40. With this arrangement, the support bar 46 also provides a convenient rear handle 48, seen in FIG. 2, which may be used to assist someone in pushing the device, when empty. The support bar 46 also provides structural integrity to the seat assembly. All the seat surfaces which contact the user are preferably padded for comfort.

The seat assembly 38 also includes a slide track assembly 49 (see FIG. 5) which comprises two sections of tube 50, each having a longitudinal slot 52, preferably formed through only one wall of each tube section 50.

Figure 4:
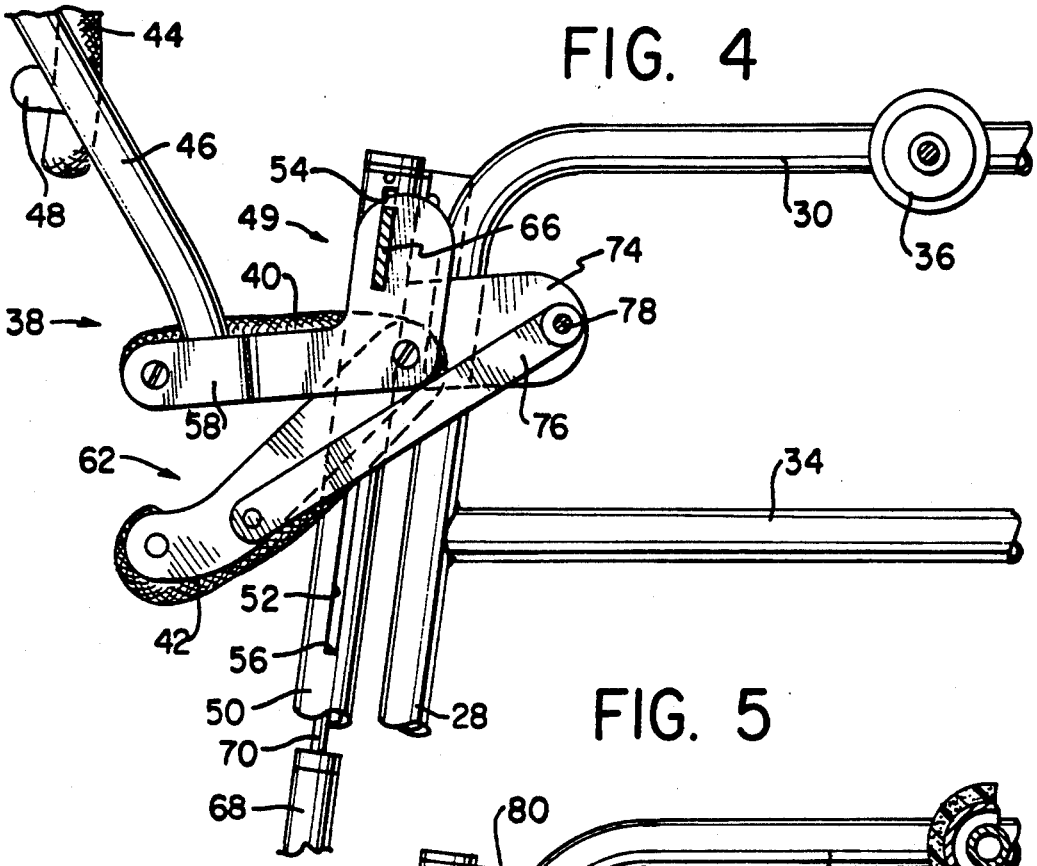
FIG. 4 is a side view of the seat assembly of the invention showing the seat in a stowed and raised position.

The slots 52 do not extend fully to the ends of the tube sections 50 and define an upper stop 54 and a lower stop 56, as seen in FIG. 4, as discussed further below.

Figure 2:
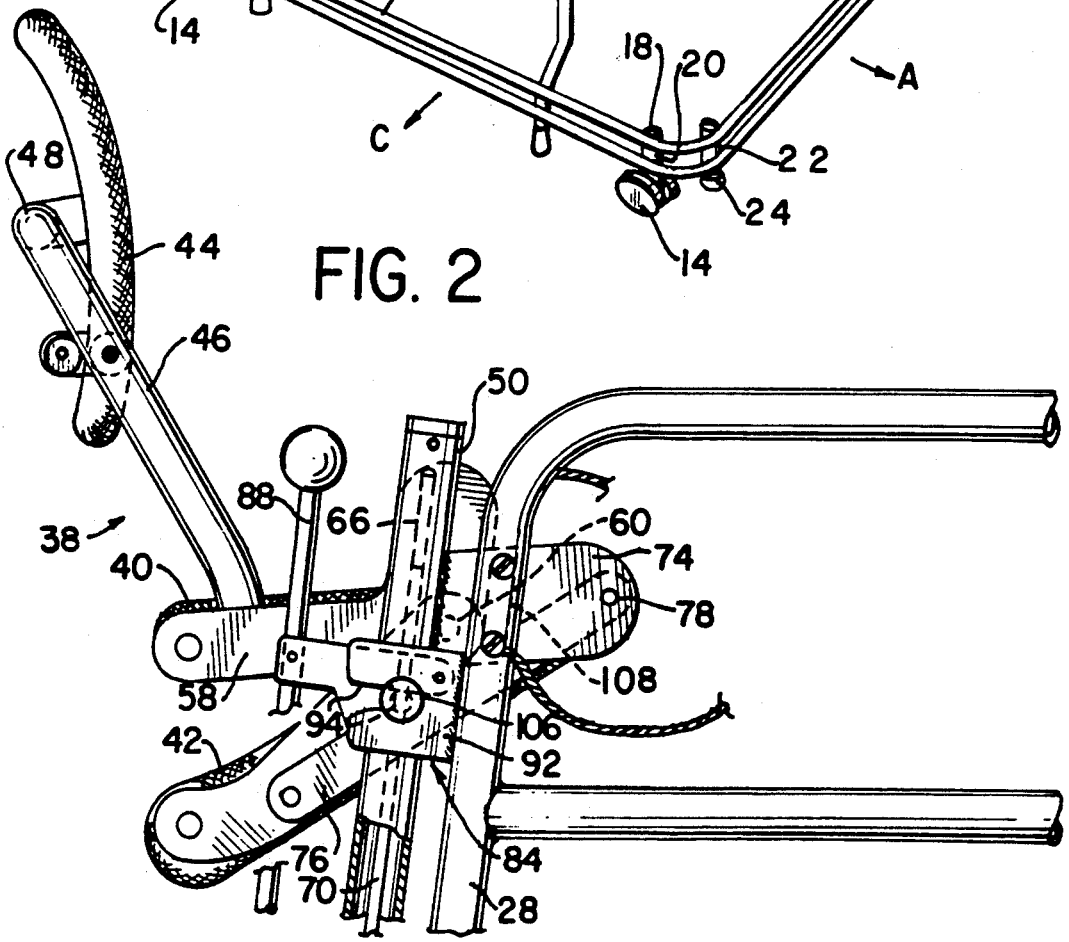
FIG. 2 is a side view of the seat assembly in accordance with the invention.
Figure 3:
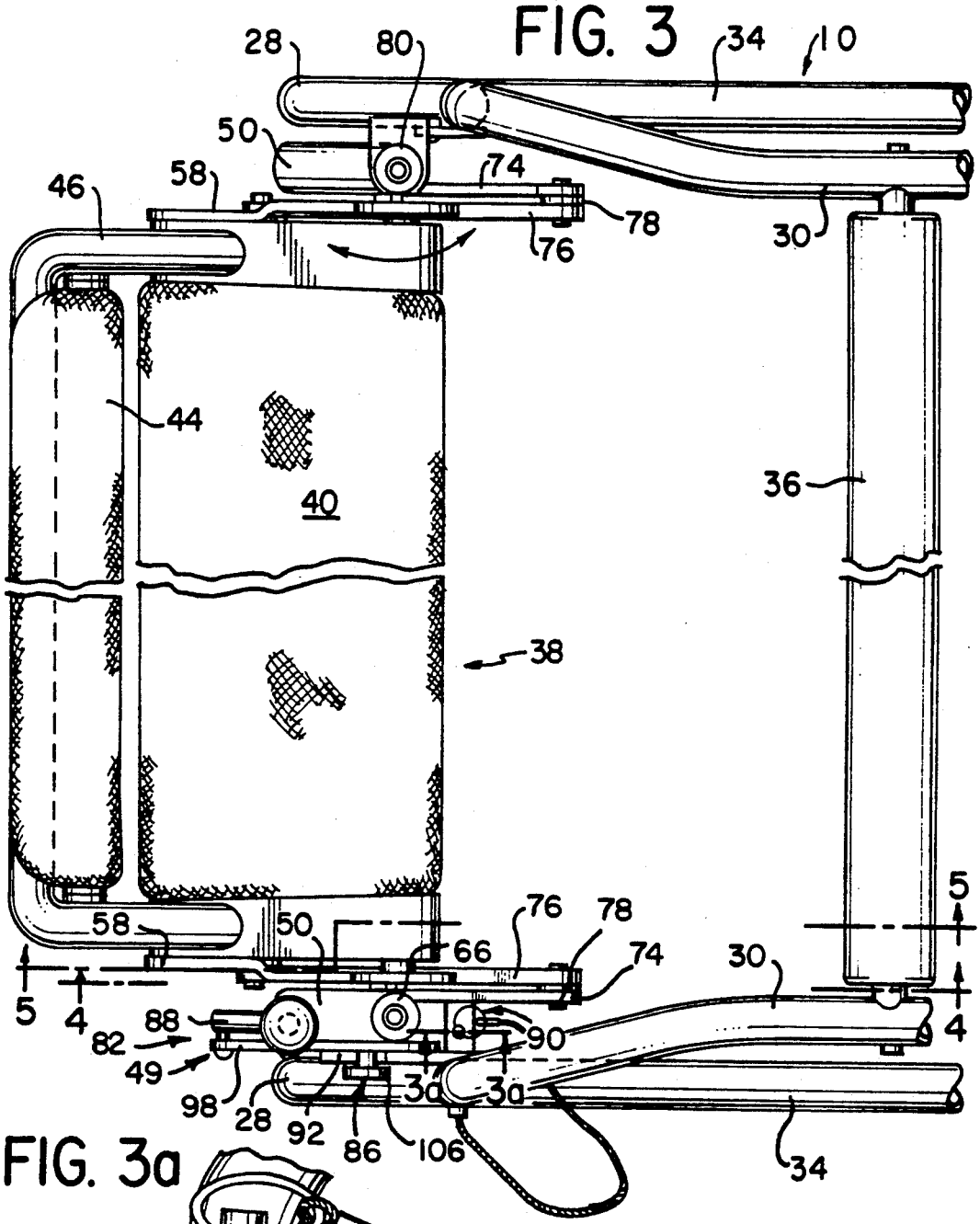
FIG. 3 is a top view of the seat assembly in accordance with the invention showing the seat assembly in a closed and locked position.
Figure 3A:
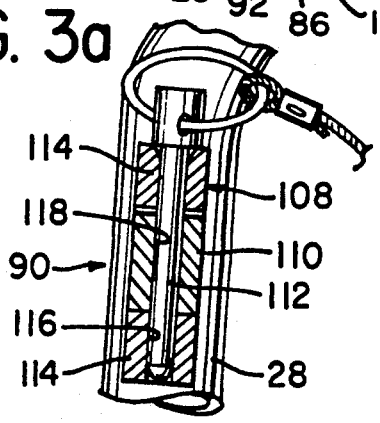
FIG. 3*a* is a partial cross-sectional view taken along the line 3*a*—3*a* of FIG. 3 showing a locking pin in accordance with the present invention.
Figure 5:
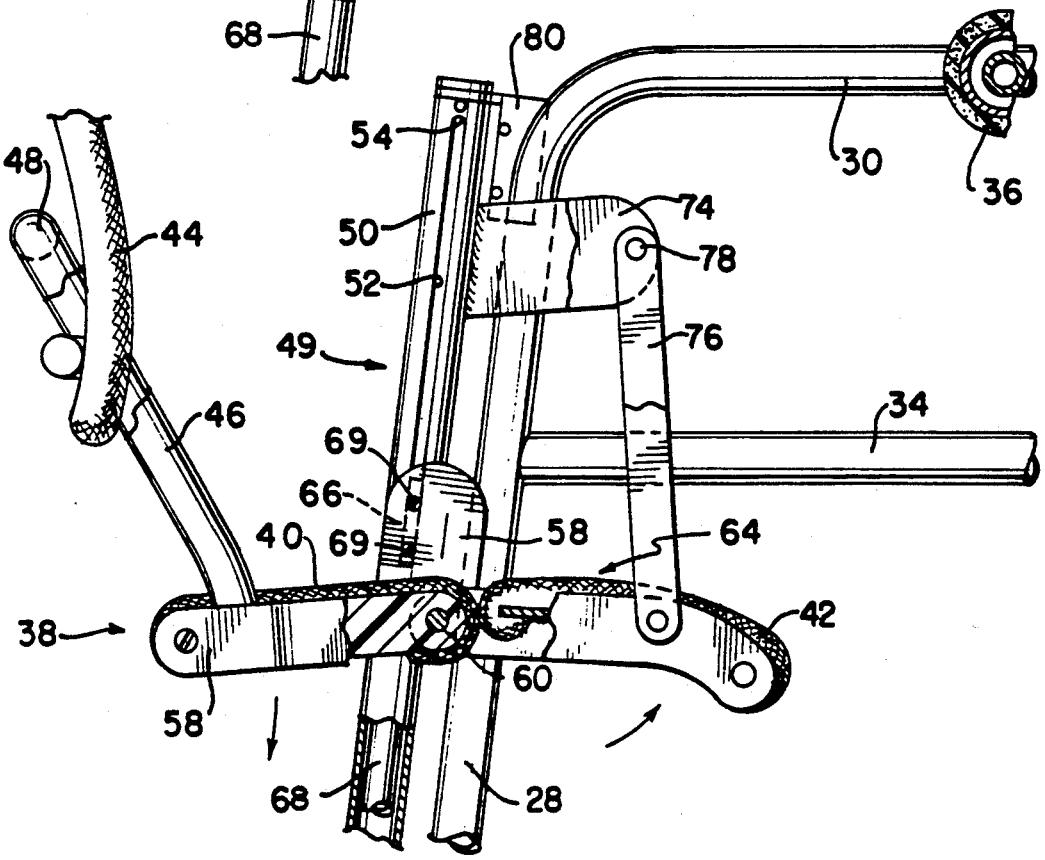
FIG. 5 is a side view of the seat assembly of the invention showing the seat in an operative and lowered position.

On each side of the bottom seat 40 is secured an L-shaped slide mount 58 (with the "L" lying on its side pointing upwardly). The thigh support 42, being positioned between the two slide mounts 58, is pivotally attached to the slide mounts 58 using bolts or rivets. The thigh support 42 may swing about an axis 60 between a folded position 62, shown in FIGS. 2 and 4, and an extended position 64 shown in FIG. 5. Mechanically, when the seat assembly 38 is located in a raised position, as shown in FIG. 2, the thigh support 42 will be in its folded position 62 and when the seat assembly 38 is located in a lowered position (comfortable height for sitting), as shown in FIG. 5, the thigh support 42 will be in its extended position 64. The thigh support 42, when extended, will be generally coplanar with the bottom seat portion 40 and enlarges the supporting surface provided by the bottom seat portion 40.

Also attached to each slide mount 58 is a slide block 66, as seen in FIG. 4, which is shaped to fit snugly into the slot 52 of each respective tube section 50. The slide block 66 slides within the slot 52 between the upper and lower stop positions 54, 56. Slide block 66 may be made from any metal and lubricated within the slot, or may be made from a strong self-lubricating plastic such as nylon. The slide block 66 is attached to the slide mount 58 with at least two bolts 69 so that the attached bottom seat 40 of the seat assembly will remain at a preferable horizontal orientation as shown in FIGS. 2, 4 and 5. Positioned within each tube section 50 is a pneumatic cylinder cartridge 68 of the type commonly used to assist in raising the hatchback door of an automobile, for example. The cartridge 68 has an output shaft 70 whose end is attached to each respective slide block 66 from within the tube section 50. The cylinder portion 72 of each cartridge 68 is fixed to the lower portion of each respective tube section 50 so that each slide block 66, the attached slide mount 58 and the entire seat assembly 38 is spring-biased towards the upper stop 54 of the slots 52. It is the upward force developed by the spring-bias of the cartridges 68 which keep the seat assembly in the raised and folded position when not used and assist a seated user in standing upright from the seat.

A connecting-bar support 74 is attached to the upper portion of each tube section 50, as shown in FIGS. 2 and 5. The connecting-bar supports 74 are therefore fixed with respect their tube sections 50. A connecting-bar 76 is pivotally attached, at one end, to each respective connecting-bar support 74 using a rivet, or bolt 78. The other end of each connecting-bar 76 is pivotally attached to each respective side of the thigh support 42. The length of each connecting-bar 76 is such that when the slide block 66 of the seat assembly 38 is against the upper stop 54 of the slot 52 the connecting-bar 76 pushes the thigh support 42 to its swung-down position 62, as shown in FIG. 4. When the seat assembly 38 is pushed down against the spring bias action of each pneumatic cartridge 68 so that each slide block 66 abuts against its lower stop point 56 within its slot 52, the length of the connecting-bar 76 is such that the thigh support 42 is pulled about the pivot axis 60 to its swung-up (horizontal) position 64, as shown in FIG. 5. This action is described further in the "operation" section below.

As mentioned earlier, the entire seat assembly 38 including the slide track assembly 49 is attached to the back end B of the frame structure 26 between the two rear support tubes 28 so that the entire seat assembly 38 may swing open similar to a gate and provide access to within the frame structure 26. This gate-swinging action is accomplished by hinging one tube section 50 to one rear support tube 28 with a hinge 80. The other tube section 50 is attached to the opposing rear support tube 28 (the non-hinged rear support tube) with a latching assembly 82 which is described in greater detail below with reference to FIG. 7.

The latching assembly 82 comprises upper and lower latches 84, a pair of engagement pegs 86, as shown in FIG. 6, a release bar 88 and a locking assembly 90. Each latch 84 includes a strike plate 92 which is essentially a plate of metal (or other material) attached to the non-hinged rear support tube 28, as shown in FIGS. 2 and 7. The strike plate 92 includes a slot 94 extended into the plate from its rear edge 96. The slot 94 has an entrance which is beveled to assist in alignment during latching, as described below. A pivotal latching plate 98 is pivotally attached to each strike plate 92 using a rivet or bolt. The latching plate 98 has a slanted rear edge 100 and a latching cutout 102. The latching plate 98 is pivotal between an open position where the slot 94 of the adjacent strike plate 92 is open to receive an engagement peg 86 (described below), and a latched position (see FIG. 2) where the latching plate 98 is in an overlapping arrangement with the slot 94 and its latching cutout 102 effectively retaining an engagement peg 86 located fully within the slot 94. The two pivotal latching plates 98 are connected together by the release bar 88 which synchronizes their pivotal movement adjacent their respective strike plates 92. The latching plates 98 and/or the release bar 88 may be spring biased to a latched position with a spring (not shown). The weight of the release bar 88 will already provide some latched-position biasing.

The engagement pegs 86 are both connected to the non-hinged tube section 50 so that each aligns with the slots 94 of their respective strike plates 92. Each engagement peg 86 preferably includes a shaft portion 104 which only slightly smaller than the width of the slots 94 and a head portion 106 which is larger than the width of the slots 94. The large head portion 106 helps retain an engagement peg 86 within a slot 94 after it has been latched. The latching operation is described in detail below.

The locking assembly 90 includes a locking bracket 108 which is attached to the non-hinged rear support tube 28, a locking tab 110 which is attached to the connecting-bar support 74, and a locking pin 112. The locking bracket includes two integral outwardly extended parallel plate sections 114, each having an opening 116 sized to snugly receive the locking pin 112. The plate sections 114 are distanced from each other so that the locking tab 110 may slide between the two plate sections 114. The locking tab 110 has a similar opening 118, also sized to receive the locking pin 112. When the seat assembly 38 is in its closed position, the three openings 116, 118, of the locking assembly 90 will align and, upon insertion of the locking pin 112, will lock together thereby locking the seat assembly 38 in the closed position (see FIG. 7). The seat assembly 38 will remain locked regardless of the condition of the latching assembly 82 until the locking pin 112 is removed from the aligned openings 116, 118, of the locking assembly 90.

In operation, a user approaches the back end B of the device 10 and pulls the locking pin 112 from within the openings 116, 118 (assuming the pin 112 is engaged in its locked position). The release bar 88 is then lifted which pivots both locking plates 98 out of overlapping engagement with the slot 94 of each strike plate 92. At this time the gate-like seat assembly 38 may be swung from the closed position shown by FIG. 3 to the open position shown (not fully open) in FIG. 6. The engagement pegs 86 will leave the strike plates 92 as the seat assembly 38 is swung open.

The user now has an open passage to within the frame structure 26 of the device 10. Once inside the device 10, the user (or an assistant) closes the seat assembly 38. As the seat assembly 38 closes, the shaft portions 104 of each engagement peg 86 will strike the slanted rear edge 100 of the respective locking plate 98 which will cause the two locking plates 98 and the release bar 88 to raise and open the slot 94 of the strike plate 92. The engagement peg 86 will essentially push its way within the slot 94 until it reaches the front end of the slot 94, at which point the weight of the release bar 88 causes both locking plates 98 to fall and their latching cutout 102 to "capture" the shaft portions 104 of the engagement pegs 86.

Once the seat assembly is in its closed position (see FIG. 3) the user (or assistant) may lock the seat assembly in its closed position by reinserting the locking pin 112 into the aligned openings 116, 118 of the locking assembly 90. In either case, the user may walk about using the device 10, directing it by using the handle frame 30 and the waist support bar 36. Every time the user pushes down on the handle frame 30, the dolly frame 16 drops to its lower position allowing the non-skid feet 24 of legs 22 to firmly grip the floor. With the thigh support 42 in its fully folded position, the user has ample room between the seat 40 and the waist support bar 36 to comfortably maneuver. Also, since the seat assembly 38 is raised with the slide block 66 up against the upper stop 54 of the slot 52, there is more room available in the rear of the device for the user to extend his stride rearwardly or even drag one or both feet as he or she walks without touching the seat assembly 38.

However, should the user wish to sit (or accidently fall backwards), the instant he or she contacts the bottom seat 40 of the seat assembly 38, the user's weight will push it down forcing the slide blocks 66 to slide, against the spring action of the pneumatic cartridge, from the upper stop 54 to the lower stop 56. During this movement, the connecting-bar 76 which is attached to the stationary connecting-bar support 74 will work together with the slide mount 58 to move the thigh support 42 out from under the bottom seat 40. The thigh support 42 will quickly pivot about axis 60 from its folded (stowed) position (FIG. 4) to its extended position (FIG. 5). The thigh support 42 will "catch" the user as he or she sits (or falls) and provide ample support to retain the user in the seated position. The weight of the user will be in part supported by the now rigid connection between the thigh support 42 and the connecting-bar support 74 by the connecting-bar 76.

Once seated, the user may lean forward and rest against the waist support bar 36.

As the user stands, the spring action of the pneumatic cartridge 68 to push the slide blocks 66 upwardly from the lower stop 56 back to the upper stop 54. This spring force causes the bottom seat 40 to also raise, which effectively draws the thigh support 42 backwards under the rising bottom seat 40. Simultaneously, the connecting-bar 76 pushes the thigh support 42 back to its folded position. The spring force of the pneumatic cartridge offers some raising assistance to the user trying to stand.

Once the user's weight is off the seat assembly 38, the seat assembly 38 will once again be out of his way, and the device may once again be used as a walking aid.

Although the above-described embodiments of the invention are directed to either walkers, chairs or a combination of both, the invention may also be combined with the function of a wheelchair. To incorporate the function of a wheelchair with the above-described invention, larger rear wheels may be preferable so that a seated user may move the walker like a conventional wheelchair, i.e., by controlling the rotation of the larger rear wheels directly with his hands.

Additionally, since the non-skid feet 24 contact the floor surface whenever weight is applied to the chair assembly 38, this action must be prevented using a pin or other means so that the assembly may be rolled along the floor surface (either by a patient or an assistant) with a patient seated.

What is claimed is:

1. A device for supporting a person while standing, sitting, or walking along a floor surface, said device comprising:

a frame assembly, defining a walking zone in which said person may walk or stand;

a bottom seat assembly attached to said frame assembly, said seat assembly including a first seat portion, and a second seat portion hingedly connected to said first seat portion, said bottom seat assembly being vertically movable with respect to said frame assembly between a stowed position wherein said bottom seat assembly is retracted relative to said walking zone and an operational position located substantially adjacent to said walking zone;

means for maintaining said first seat portion of said bottom seat assembly substantially horizontal with respect to said floor at all times regardless of the vertical position of said bottom seat assembly with respect to said frame assembly; and means for moving said seat assembly between said stowed and operational positions, said moving means being responsive to a downward force;

whereby said downward force may be provided by a person sitting on said bottom seat assembly.

2. The device according to claim 1, wherein said bottom seat assembly is spring biased towards said stowed position.

3. The device according to claim 1, further comprising wheels attached to said frame assembly for allowing said frame assembly to be easily moved along said floor surface.

4. The device according to claim 3, further comprising means for frictionally engaging said frame assembly with said floor surface, thereby preventing said frame assembly from moving with respect to said floor surface.

5. The device according to claim 4, wherein said wheels are slidably mounted to said frame assembly so that said frame assembly is moveable vertically between an upper position and a lower position with respect to said floor, said frame assembly being spring-biased to said upper position, said frictionally engaging means engaging said floor surface when said frame assembly is pushed downwardly towards said lower position sufficiently to overcome the upwardly directed force of said spring-bias.

6. The device according to claim 5, wherein said frictionally engaging means frictionally engages said floor surface when said frame assembly is pushed downwardly towards said lower position with a force sufficient to overcome the upwardly directed force of said spring bias.

7. A device for supporting a person while standing or sitting, or walking on a floor, said device comprising:

a frame assembly, defining a walking zone in which said person may walk or stand;

a bottom seat assembly attached to said frame assembly, said bottom seat assembly including a first seat portion, and a second seat portion hingedly connected to said first seat portion, said bottom seat assembly being movable with respect to said frame assembly between a raised stowed position retracted from said walking zone and an operational position located substantially adjacent to said walking zone;

means for maintaining said first seat portion of said bottom seat assembly generally horizontal with respect to said floor regardless of the position of said seat assembly with respect to said frame assembly; and means for biasing said movable seat assembly toward said raised stowed position, said seat assembly being movable from said raised stowed position to said lowered operational position by application of a downward force, said biasing means being able to forcibly move said bottom seat assembly towards said raised stowed position when a downward force is absent.

8. The device according to claim 7, wherein said biasing means includes a pneumatic cartridge actuator.

9. The device according to claim 7, wherein said frame assembly is generally U-shaped and having an open side, said frame assembly includes a walking zone where said person stands to operate said device, said open side providing access to said walking zone for said person.

10. The device according to claim 9, wherein said bottom seat assembly is hingably attached to said frame assembly across said open side, said bottom seat assembly being swingable between an open position wherein said open side provides access to said walking zone and a closed position wherein said open side is closed and no access is provided.

11. The device according to claim 10, further comprising means to latch said bottom seat assembly in said closed position, said latch means being releasable by movement of an accessible lever.

12. The device according to claim 11, further comprising means to lock said bottom seat assembly in said closed position, said lock means preventing unintentional movement of said bottom seat assembly from said closed position.

13. An automatically collapsible bottom seat assembly for use with a walking aid device f the type having a frame assembly, wherein said frame assembly defines a walking zone, said bottom seat assembly collapsing when not needed to provide ample room within said walking zone for a person using said walking aid device, said seat assembly comprising:

a first seat portion adapted to be attached to said frame assembly, said bottom seat assembly being movable with respect to said frame assembly between a stowed position and an operational position;

means for maintaining said first seat portion of said bottom seat assembly substantially horizontal regardless of the position of said bottom seat assembly with respect to said frame assembly;

a second seat portion pivotally attached to said first seat portion between a collapsed position wherein said second seat portion is retracted from said walking zone of said frame assembly and a supportive position wherein said second seat portion lies adjacent to and substantially coplanar with said first seat portion, whereby said second seat portion in said supportive position may provide support to a person using said seat assembly; and means for automatically moving said second seat portion between said collapsed position and said supportive position, said moving means being responsive to said movement of said first seat portion between said stowed and operational positions.

14. The bottom seat assembly according to claim 13, wherein said means for automatically moving moves said second seat portion from said collapsed position to said supportive position when said first portion moves from said stowed position to said operational position.

15. The bottom seat assembly according to claim 14, further comprising means for biasing said first seat portion toward said stowed position.

16. The seat assembly according to claim 13, further comprising means for biasing said second seat portion to said collapsed position.

17. The device according to claim 1, wherein said moving means includes a guide assembly attached to said frame assembly, said guide assembly receiving a portion of said seat assembly so that as said seat assembly moves, said guide assembly guides said seat assembly between said stowed position and said operational position.

* * * * *